United States Patent [19]

Bessinger et al.

[11] Patent Number: 5,013,091

[45] Date of Patent: May 7, 1991

[54] METHOD OF INDIRECT MEASUREMENT OF COWL POSITION ON A LONGWALL SHEARER

[75] Inventors: Stephen L. Bessinger, Morgantown, W. Va.; Michael G. Nelson, Fairbanks, Ak.

[73] Assignee: Consolidation Coal Company, Pittsburgh, Pa.

[21] Appl. No.: 455,102

[22] Filed: Dec. 22, 1989

[51] Int. Cl.[5] ..... E21C 35/20

[52] U.S. Cl. ..... 299/1; 299/45

[58] Field of Search ..... 299/1, 42, 45, 67

[56] References Cited

U.S. PATENT DOCUMENTS

| | | | |
|---|---|---|---|
| 4,006,935 | 2/1977 | Gapper et al. | 299/1 |
| 4,068,894 | 1/1978 | Dring | 299/45 |

FOREIGN PATENT DOCUMENTS

| | | | |
|---|---|---|---|
| 2652614 | 7/1980 | Fed. Rep. of Germany | 299/45 |
| 604996 | 4/1978 | U.S.S.R. | 299/45 |
| 2174443 | 11/1986 | United Kingdom | 299/1 |

*Primary Examiner*—Ramon S. Britts
*Assistant Examiner*—David J. Bagnell
*Attorney, Agent, or Firm*—Alan McCartney

[57] ABSTRACT

The position of the cowl on a longwall shearing machine is determined by loads, stresses or deflections measured on the ranging arm, clevis and pin connection on the ranging arm or lift cylinder and its linkage to the machine.

3 Claims, 1 Drawing Sheet

METHOD OF INDIRECT MEASUREMENT OF COWL POSITION ON A LONGWALL SHEARER

BACKGROUND OF THE INVENTION

1. Field of the Invention

This invention relates to a method of determining the position of the cowl on a longwall shearer by measuring the change in function of apparatus associated with the operation of the ranging arm.

2. Summary of the Prior Art

One system for mining involves a longwall machine commonly called a ranging arm shearer and comprises cutter drums carried on arms pivotally mounted on the machine body. The machine traverses the longwall face of, for example, a coal panel, and deposits the mined material onto a conveyor for transport. Cowls are mounted on the ranging arm to guide the mined material from the cutter onto the conveyor.

As the machine completes the pass of the longwall face and prepares to reverse direction, a headgate or tailgate cutout is performed at which time it is necessary to rotate the cowl from one side of the drum to the other so that the cowl is on the trailing side of the cut. At this sequence of the mining scheme, it is desirable to know the cowl has been moved.

An investigation of the prior art revealed only two patents which appear pertinent. U.S. Pat. No. 4,006,935 teaches a ranging arm shearing machine having sensing means for sensing the position of the rotational axis of a cutter drum mounted on a ranging arm relative to the pivotal axis. U.S. Pat. No. 4,371,209 shows mining machines having ranging drums and sensor means for sensing the position of the axis of the drum and controlling that position in the present cut to duplicate the previous cut.

SUMMARY OF THE INVENTION

It is the purpose of this invention to provide a method for determining the position of the cowl on a longwall shearer having a cutter carried on a ranging arm by measuring the change in function of apparatus associated with the operation of the ranging arm.

It is also an object of this invention to provide a method for determining the position of the cowl on a longwall shearer by measuring the change in pressure on the ranging arm lift cylinder as the cowl is rotated from its innermost to its outermost position.

SUMMARY OF THE PREFERRED EMBODIMENT

Figure 1A:
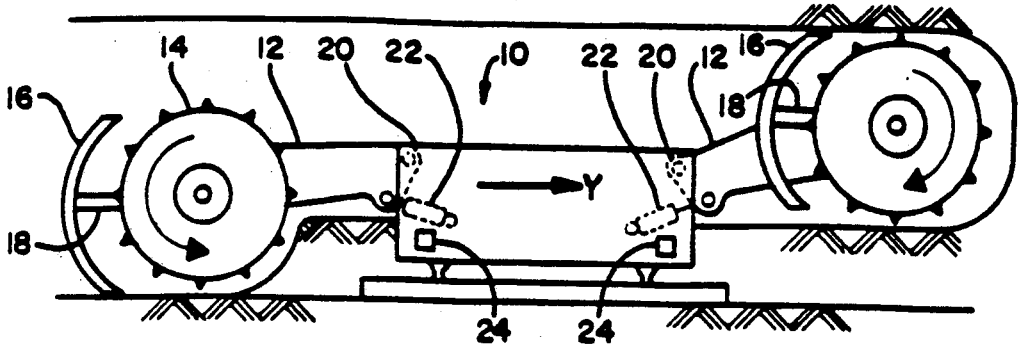
FIGS. 1*a* and 1*b* are diagrammatic illustrations of a longwall shearer traveling in different directions as the machine would traverse the face.
Figure 1B:
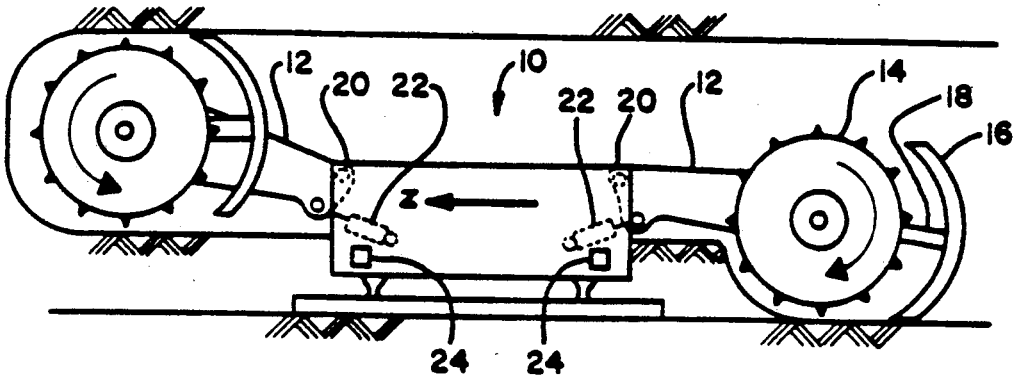

Attention is now directed to FIGS. 1*a* and 1*b* which illustrate the longwall shearer 10 traversing the face in opposite directions as shown by arrows Y and Z. The machine 10 has ranging arms 12 which carry cutters 14 with cowls 16 mounted on arms 18 guiding the mined material onto a conveyor (not shown) for transport. As the machine completes a pass of the face and reverses to begin another pass, the cutters are raised and lowered to cover the entire face. The ranging arms are pivoted about the clevis pin 20 by the hydraulic lift cylinder 22.

As the machine completes a face pass a headgate or tailgate cutout is performed at which time the cowl is rotated from one side of the cutter to the other so that the cowl will trail the cutter. If the cowl is not completely rotated, the application of the cutter haulage thrust as the machine reverses direction will cause damage to the cowl. Complete rotation of the cowl may be difficult because of malfunction of cowl turning drives (not shown) which power the cowl, or debris such as coal or rock may block cowl arm function.

In providing an automated robotic control system for a longwall shearer it is necessary to provide the master control the information that the cowl has been rotated at the gate roads. This can be accomplished by measuring the change in pressure on the ranging arm lift cylinder 22. A sensor 24 in the hydraulic circuit of cylinder 22 can communicate with the machine control to indicate the cowl rotation has been completed.

Figure 2:
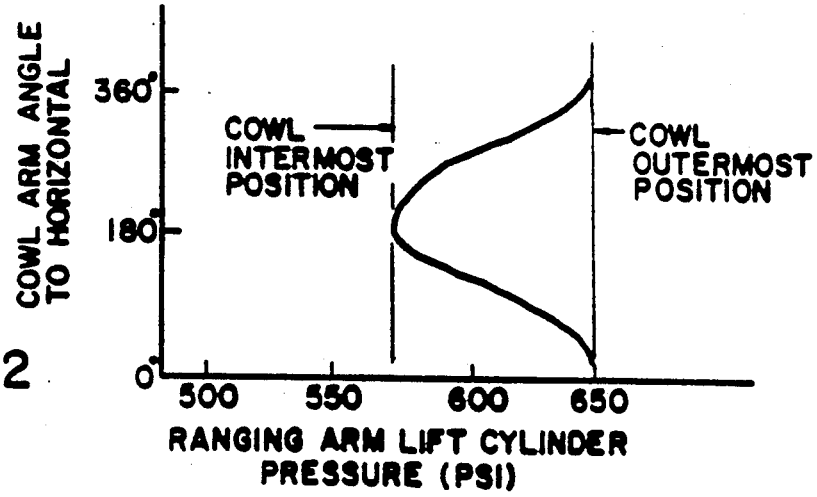
FIG. 2 is a graph illustrating the change in the ranging arm lift cylinder pressure for a given machine as the cowl is rotated from its innermost position to its outermost position.

As illustrated in FIG. 2, the calculated ranging arm lift cylinder pressure is about 650 psi (for a given machine) when the cowl is in the outermost position with the center of the mass of the ranging arm, cutter, cowl and cowl arm, etc. being furthest from the clevis pin. As the cowl is rotated 180 degrees, the center of the mass of the ranging arm and associated parts moves toward the clevis pin reducing the pressure in the lift cylinder. This change in pressure can be detected by sensor 24 and communicated to the machine control. The shape of this pressure cycle curve as illustrated in FIG. 2 is relatively insensitive to changes in the ranging arm inclination and thus is indicative of cowl position over the full range of cutter positions.

Since the ranging arm of any modern shearer is connected to the shearer body by a clevis, moments can be summed about the clevis pin, and the force required to maintain ranging arm elevation will be found to increase markedly when the cowl is turned from between the drums to outside the drum. This change in position is calculated to produce a 15% increase in the load on the theoretical lever which generates torques about the clevis pin and raises the ranging arm. A 75 psi change in hydraulic cylinder pressure is expected for the ranging arm lift cylinder, when the cowl is rotated.

This invention is intended to cover any methods by which the position of the cowl on a longwall shearing machine is determined by loads, stresses, or deflections measured in the ranging arm, clevis pin connection, or the ranging arm lift cylinder and its linkage to the device.

We claim:

1. In a longwall shearer having a cowl rotatably supported on a ranging arm, said ranging arm pivotably supported on the shearer by apparatus including a clevis pin and a lift cylinder, the method of determining the rotated position of the cowl on the ranging arm by sensing the load on at least a portion of said apparatus.

2. The method of claim 1 whereby said step of sensing the load comprises sensing the change in pressure internal to the lift cylinder as the cowl is rotated.

3. The method of claim 1 including determining the moments about the clevis pin as the cowl is rotated.

* * * * *